US012018539B2

(12) United States Patent
Søyland

(10) Patent No.: US 12,018,539 B2
(45) Date of Patent: Jun. 25, 2024

(54) RADIAL DRILLING UNIT

(71) Applicant: Altus Intervention (Technology) AS, Stavanger (NO)

(72) Inventor: Erlend Søyland, Stavanger (NO)

(73) Assignee: ALTUS INTERVENTION (TECHNOLOGY) AS, Stavanger (NO)

( * ) Notice: Subject to any disclaimer, the term of this patent is extended or adjusted under 35 U.S.C. 154(b) by 0 days.

(21) Appl. No.: 17/938,413

(22) Filed: Oct. 6, 2022

(65) Prior Publication Data

US 2023/0111830 A1 Apr. 13, 2023

(30) Foreign Application Priority Data

Oct. 7, 2021 (NO) ..... 20211208

(51) Int. Cl.
*E21B 29/06* (2006.01)

(52) U.S. Cl.
CPC ..... *E21B 29/06* (2013.01)

(58) Field of Classification Search
CPC ..... E21B 29/06
See application file for complete search history.

(56) References Cited

U.S. PATENT DOCUMENTS

| | | | | |
|---|---|---|---|---|
| 6,772,839 | B1 | 8/2004 | Bond | |
| 9,097,109 | B2 * | 8/2015 | Boekholtz | E21B 43/112 |
| 10,502,035 | B2 * | 12/2019 | Sandkleiva | E21B 43/11 |
| 10,557,312 | B2 | 2/2020 | Andersen | |
| 2008/0135226 | A1 | 6/2008 | Lewis | |
| 2012/0279710 | A1 | 11/2012 | Boekholtz | |

(Continued)

FOREIGN PATENT DOCUMENTS

| | | | |
|---|---|---|---|
| CN | 102635310 | A | 8/2012 |
| CN | 103195387 | B | 7/2013 |
| CN | 104695886 | A | 6/2015 |

(Continued)

OTHER PUBLICATIONS

Application No. DKPA202270472 , Office Action, Mailed On Jul. 11, 2023, 8 pages.

(Continued)

*Primary Examiner* — Taras P Bemko
(74) *Attorney, Agent, or Firm* — KILPATRICK TOWNSEND & STOCKTON LLP

(57) ABSTRACT

The invention relates to a radial driller for drilling a hole in a well tubular, the radial driller comprising a rotating sleeve that is rotated by means an axial drive organ via an angular gear, the rotating sleeve housing a partially closed cylinder, the cylinder housing a hydraulic piston, a first hydraulic chamber situated below the hydraulic piston, and a second hydraulic chamber situated above the hydraulic piston, the hydraulic piston having a connecting rod arrangement extending above the piston and through an opening in a dividing wall dividing the cylinder from a multipurpose section, and a drill bit connected to the hydraulic piston via the connecting rod arrangement. According to the invention, the radial driller further comprises a multipurpose element positioned directly below the drill bit, the multipurpose element defining a retracting chamber between the multipurpose element and the dividing wall.

9 Claims, 7 Drawing Sheets

(56) References Cited

U.S. PATENT DOCUMENTS

| | | | | |
|---|---|---|---|---|
| 2015/0260020 | A1* | 9/2015 | Benson | E21B 29/00 166/55.2 |
| 2017/0350193 | A1* | 12/2017 | Andersen | E21B 41/0085 |

FOREIGN PATENT DOCUMENTS

| | | | |
|---|---|---|---|
| NO | 20141022 | A1 | 2/2016 |
| NO | 340765 | B1 | 6/2017 |
| WO | 2011/048014 | A1 | 4/2011 |

OTHER PUBLICATIONS

GB 2213549.5; Search Report; Feb. 10, 2023; 1 page.
NO 20211208; Norwegian Search Report; dated May 5, 2022; 2 pages.

* cited by examiner

RADIAL DRILLING UNIT

CROSS-REFERENCES TO RELATED APPLICATIONS

The present application claims priority to Norwegian Patent Application No. 20211208, filed Oct. 7, 2021, the contents of which are hereby incorporated by reference in their entirety for all purposes.

FIELD OF THE INVENTION

The invention relates to a drilling unit for radial drilling a hole in a well tubular, the drilling unit comprises a rotating sleeve that is rotated by means an axial drive organ via an angular gear, the rotating sleeve housing a hydraulic cylinder and a hydraulic piston. Outside the hydraulic cylinder a rotational transferring unit is situated. The piston rod is connected to the hydraulic piston, and to the rotational transferring unit and in the end the drill bit or the milling unit.

While exerting a hydraulic pressure towards the piston in the hydraulic cylinder, and transferring rotation from the drive organ through the transferring unit will result in a radial drilling of a hole in the well tubular.

BACKGROUND OF THE INVENTION

It is well-known to perforate and establish a flow path between the interior and the exterior of a well cased with tubular elements. Traditionally perforating guns where mainly used to punch perforations through the casing, cement sheath surrounding the casing and possible into the reservoir surrounding the well. It is also known to use a radial driller to perforate the casing in order to establish communication/channel between the inner tubing and the annular space outside the tubing. It may be an advantage to avoid having to handle explosives to and on the well site, and using radial drill bits or milling bits to perforate the casings may provide another level of control and precision.

As power is finite in downhole tools, it is important to reduce the power consumption in all application to ensure the scope of work is met. When drilling, stability in the drill bit fixture ensures the drill will cut stable and consistently reducing the power required and reducing the chances for stalling the bit. Stability in the drill bit is important, but also the ability to retract the bit despite all the shavings that have been developed during drilling of the radial hole is equally important. These two abilities are vital to reduces the probability of large recovery operation of stuck tool string where the bit cannot be retracted and prevent axial motion of the tool string when pulling out of hole.

A drilling unit may use a drill bit with a bit size typically ranging from 8 mm up to 35 mm.

When pressing the drilling unit towards the well wall, the subsequent drilling will produce swarf that will occupy a limited space. Most of the swarf will be compressed in the small available space around the drill bit and may potentially compromise or destroy the hydraulic seals around the hydraulic radial drill piston. Therefore, the swarf created by the drill bit could represent a problem for the hydraulic radial drilling push and pull mechanism. Swarf could be squeezed between the piston rod and the piston cylinder and destroy or damage the elastomer that keeps the hydraulic pressure secured inside the chamber and preventing the oil from leaking out. A leakage reduces the hydraulic pressure and drains the tool until the hydraulic fluid pressure is lost.

This could result in a stuck drill bit in the casing wall, potentially requiring subsequent troublesome removal operations.

If this is not sufficient to loosen the drill bit, the entire or part of the drill string have to be disconnected and released from the stuck in well situation with a subsequent wireline run in the well to retrieve the remaining tool part.

Different examples of Prior Art drilling units for radial drilling radial holes in a casing are shown in U.S. Pat. Nos. 6,772,839, 6,772,839B1, US 2008/0135226A1, US 2011/048014A1, NO 340765B1 and U.S. Pat. No. 10,557,312B2. All these examples provide various advantageous during delivery, drilling/milling and/or subsequent operations when a flow path has been established.

U.S. Pat. No. 10,557,312B2 shows a solution were the drill bit is retracted by means of a wire/rope/chain that is arranged to pull back the extended drill bit. A pulling arrangement, comprising a spring, piston etc. for pulling on the wire/rope/chain, is positioned away from the projection piston/drill bit in order to provide a " . . . fail-safe mechanism which is always capable of retracting the tool part when the power to the tool is interrupted."

SUMMARY OF THE INVENTION

The invention seeks to provide an alternative advantageous solution to at least one of the problems mentioned above.

The invention overcomes at least one of these problems by means of a radial driller of the kind mentioned above, characterized by the features described in the enclosed independent claim 1.

Further advantageous or alternative embodiments are found in the dependent claims.

BRIEF DESCRIPTION OF THE DRAWINGS

In the following, the invention will be described in greater detail with reference to embodiments shown in the enclosed figured, which are used for example purposes only and should not unduly be used to limit the scope of the invention.

DETAILED DESCRIPTION OF THE EMBODIMENTS

Figure 1:
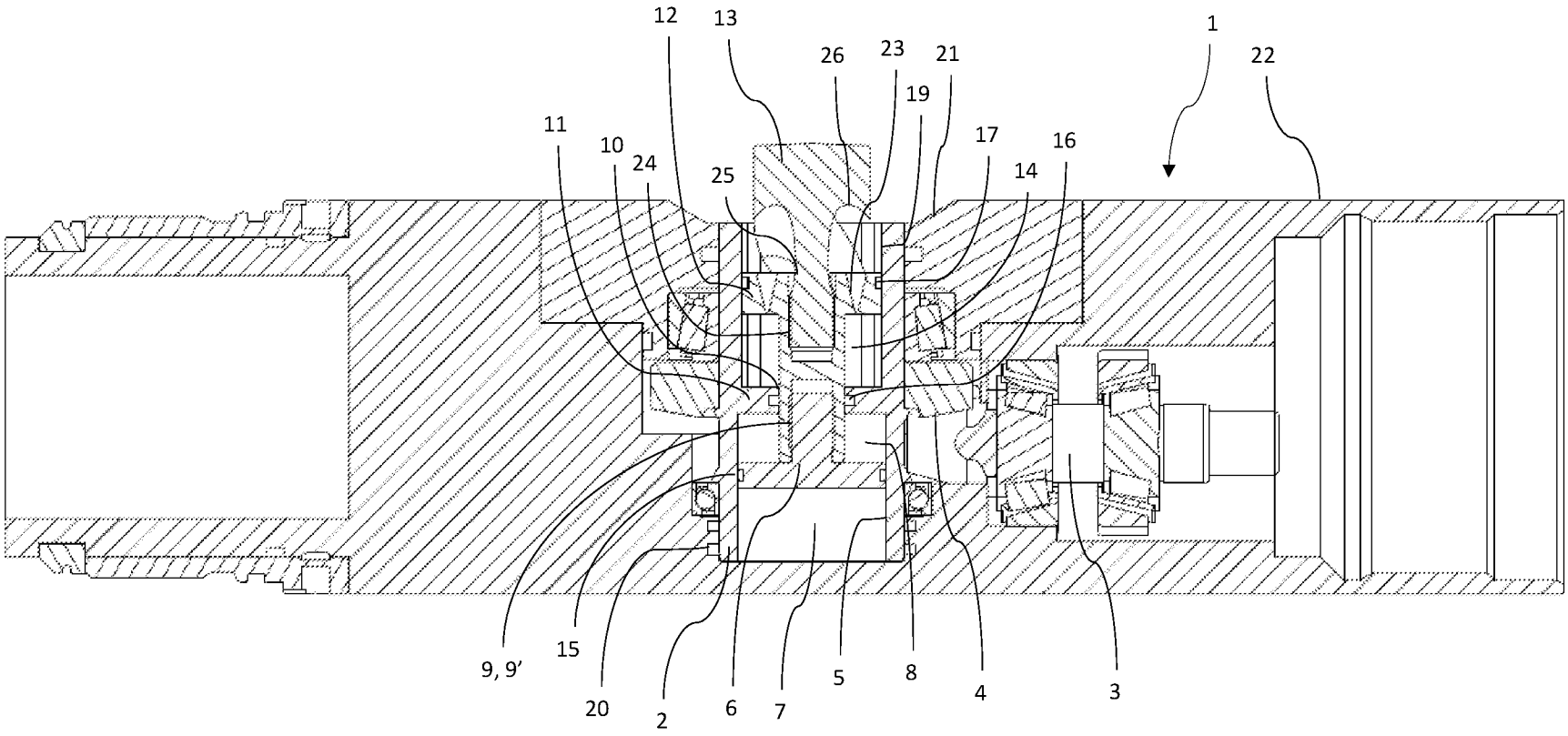
FIG. 1 shows a side view of an embodiment of the invention in a half retracted/extended position. This embodiment comprises a wiper element and a filter on a multipurpose element.

FIG. 1 shows a possible embodiment of the radial driller 1 according to the present invention. The drilling unit 1 comprises a rotating sleeve 2 that is rotated by means an axial drive organ 3 via an angular gear 4. The rotating sleeve houses a partially closed cylinder 5 with a hydraulic piston 6. A first hydraulic chamber 7 is situated below the hydraulic piston 6, and a second hydraulic chamber 8 situated above the hydraulic piston 6. The hydraulic piston 6 has a connecting rod arrangement 9, 9' which extends above the hydraulic piston 6 and through an opening 10 in a dividing wall 11 dividing the hydraulic cylinder 5 from the multipurpose section 19. The drilling unit further comprises a multipurpose element 12 which is connected via the connecting rod arrangement 9, 9' to the hydraulic piston 6. The multipurpose element 12 makes up a rotation transferring element, transferring rotation imparted from the surrounding rotating sleeve 2 to the drill bit 13. The multipurpose element 12 defines a drill bit retraction chamber 14 between element and the dividing wall 11. The multipurpose element 12 protects the interior of the radial driller 1 from ingress of swarf and ensures a volume free of swarf that the drill bit 13 can be retracted into.

As mentioned, still with reference to FIG. 1, the radial driller 1 according to the invention comprises a drive gear 3 transferring forces from an axial direction to the radial direction of the drill bit 13. The angular gears can be of worm gear type, screw gear or some type of bevel/miter gears. The rotating sleeve 2 is secured to the angular gear 4 in radial direction and supplying rotational force and stability between the rotating gear 4 and drill bit 13 to ensure no relative rotational motion between the parts.

In another example, the radial driller 1 may be designed to drill in a direction, which encloses an angle greater than 0° with the radial plane. The rotating sleeve 2 may be arranged in this direction, i.e. in the direction in which the drilling shall be conducted. In some examples, the rotating sleeve 2, cylinder 5, the hydraulic piston 6, the first and second hydraulic chamber 7,8, the connecting rod arrangement 9,9', the opening 10, the dividing wall 11, the multipurpose element 12, the drill bit 13, the drill bit retraction chamber and the multipurpose section 19 may be arranged to resemble the configuration illustrated in FIG. 1, whilst being tilted to the radial configuration of FIG. 1 to enable drilling an a direction, which encloses an angle greater than 0° with the radial plane.

The axial drive organ 3 may be arranged in another direction, e.g. the drive organ 3 may be arranged in a radial direction. In some examples, the drive organ 3 may be arranged with respect to the orientation of the rotating sleeve 2, e.g. perpendicular or parallel to facilitate the construction of the angular gear 4. The orientation of the drive organ 3 may be arbitrary with respect to the rotating sleeve 2 as a suitable angular gear 4 may be used to transfer forces from the drive organ 3 to the rotating sleeve 4.

Figure 2:
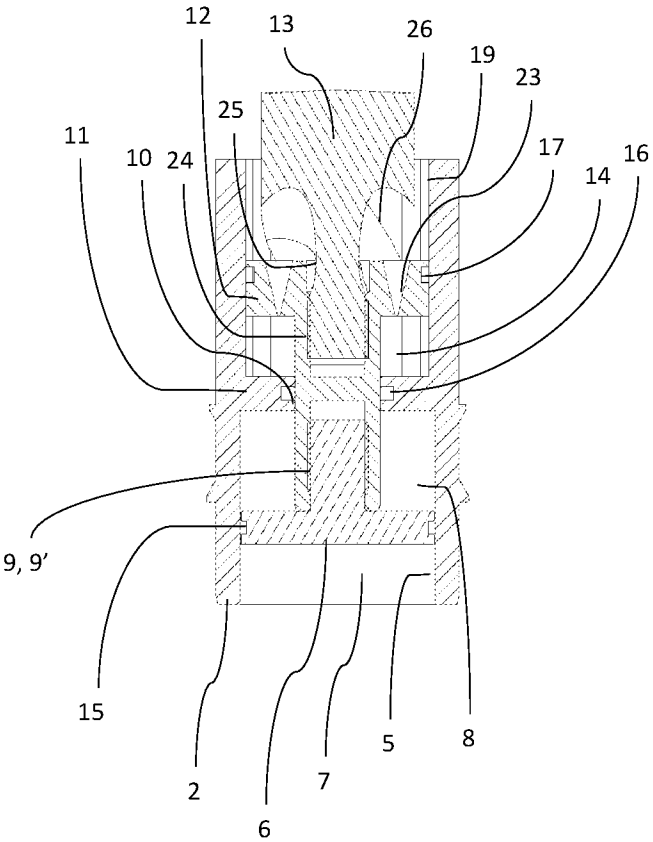
FIG. 2 shows a side view of a cut out of the embodiment shown in FIG. 1.

The rotating sleeve 2, better seen in FIG. 2, is divided into two main section, a partially closed hydraulic section 5 and a multipurpose section 19, the two sections divided by a dividing wall 11.

The hydraulic section is divided into two hydraulic chambers, a first hydraulic chamber 7 contained within hydraulic seal 15 located in the hydraulic piston 6 and hydraulic seal 20. The second hydraulic chamber 8 is contained within hydraulic seal 15 in the hydraulic piston 6 and hydraulic seal 16 located inside the dividing wall 11.

When a higher pressure is applied in the first hydraulic chamber 7 then in the second hydraulic chamber 8, a force is applied to the hydraulic piston 6 that is transferred to the multipurpose element 12 and again to the drill bit 13 causing the bit to extend.

When a higher hydraulic pressure is applied in the second hydraulic chamber 8 than in the first hydraulic chamber 7, a force is applied to the hydraulic piston 6 and retracts the multipurpose element 12 that again retracts the drill bit 13.

Hydraulic seals 15, 16 and 20 may be o-ring activated piston seals or single element seals.

According to the invention, the multipurpose section 19 of the rotating sleeve 2 contains a multipurpose element 12 that combined provides:

1. Rotation transfer between the rotating sleeve 2 and multi-purpose element 12 that again transfer rotation force to the drill bit 13
2. A clean environment to protect the integrity of the partially closed section 5 from sharp shavings from the newly drilled hole. This ensures the integrity in the second hydraulic chamber 8 ensuring that the bit can be retracted by hydraulic pressure
3. A retracting chamber 14 with sufficient size for the bit to retract into as the chamber is filled with clean oil during bit extension. When the drill bit 13 is retracted, the clean oil is drained into other parts of the tool and therefore ensuring a sufficient space for the drill bit 13 to retract in without debris.
4. Stability for the drill bit 13 during drilling as the drill bit 13 receive support around its axis of rotation from both the hydraulic piston 6 and multi-purpose part 12 that are located with a distance apart.

Figure 3:
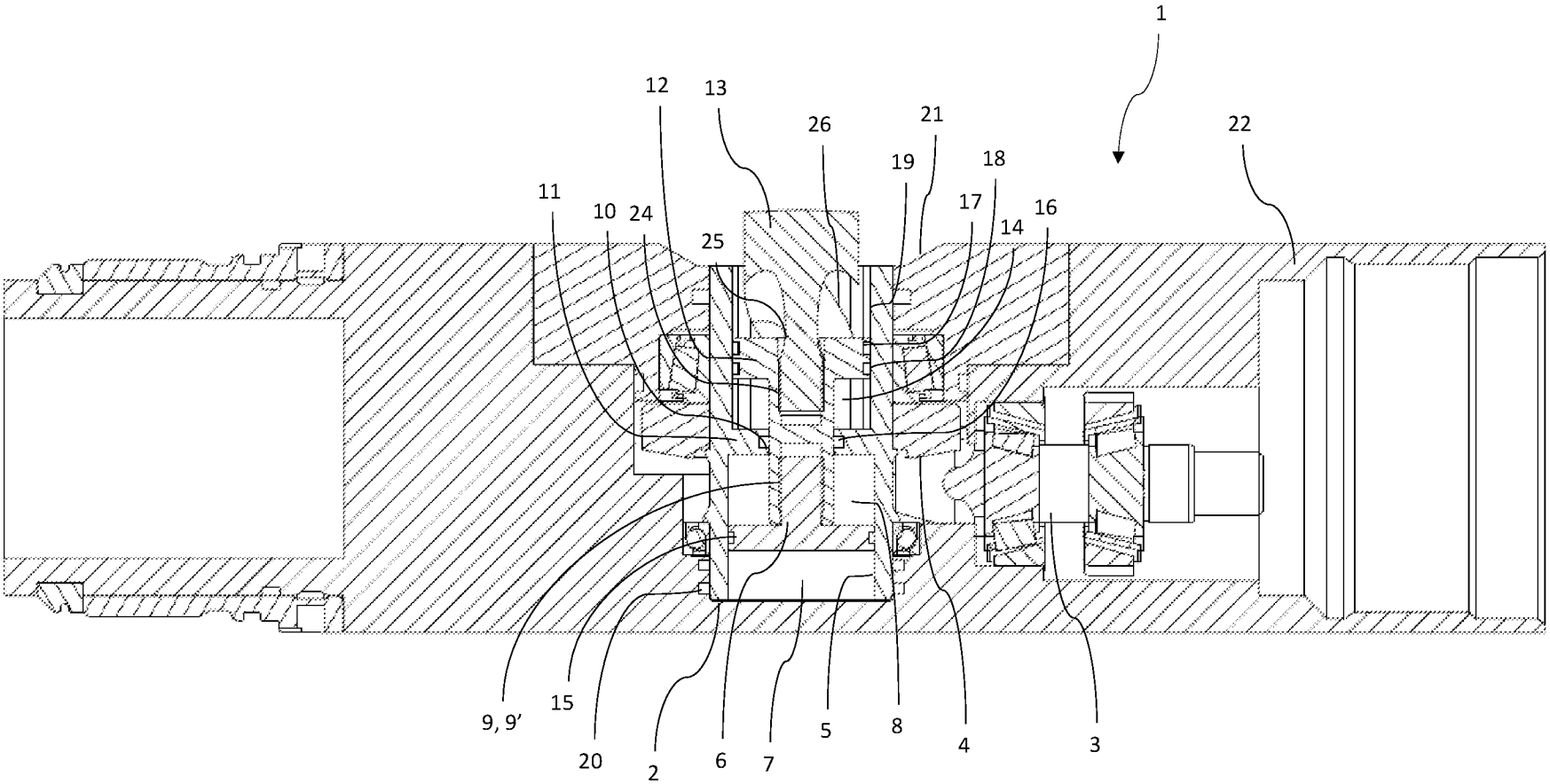
FIG. 3 shows a side view of another embodiment of the invention in a half retracted/extended position. This embodiment comprises a wiper element and a seal on a multipurpose element.
Figure 4:
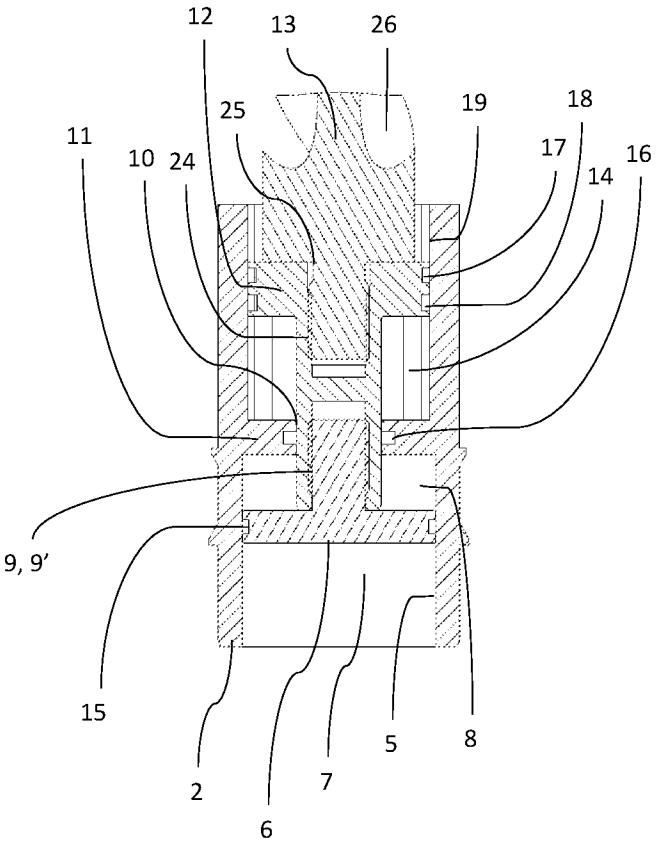
FIG. 4 shows a side view of a cut out of the embodiment shown in FIG. 3.
Figure 5:
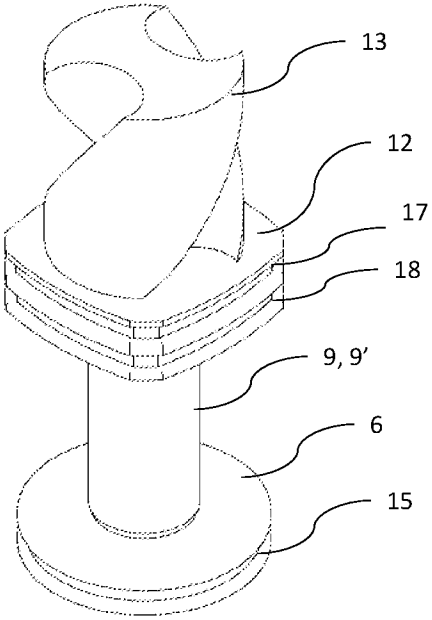
FIG. 5 shows a perspective view of an assembled hydraulic piston, multipurpose element, and drill bit corresponding to those shown in FIGS. 3 and 4.

According to one embodiment of the invention, with reference to FIGS. 3-5, the retracting chamber 14 is contained between a seal 16 in dividing wall 11 and a seal 18 around the multipurpose element 12. To ensure the integrity of seal 18, a wiper 17 is included outside seal 18 around the multipurpose element 12 to scrape of sharp shavings from the drilling and therefore creating a barrier to protect seal 18.

The hydraulic piston 6 and the multipurpose element 12 is connected by a threaded connection 9 and 9' where extension and retraction forces are transferred, ref. FIG. 5.

Also with reference to FIG. 5, the multipurpose element 12 may have a polygon shaped shape according to DIN32712 with 4 lobes, but could also be shaped according to DIN32711 with three lobes or have an oval shape with two lobes. Other shapes are also conceivable as splines, circular shape with keyed rotation transfer etc.

Possible bit retraction challenges if not having a barrier, ref. prior art: Without the multipurpose element 12, if a wide drill bit,—say 25 mm diameter—was connected to a say 10 mm diameter piston rod, retraction of the bit would have a 7.5 mm circular disk around the piston that would be required to be forced into the shavings that have been created from drilling the hole to be able to retract the bit.

When drilling with a drill bit 13, shavings and debris are produced as part of the material removal during the hole making process. To allow this debris to building up without eventually preventing the drill bit 13 from further rotation, a recess 21 is included in the drilling unit 1 to allow shavings to escape the rotating drill bit 13.

An alternative embodiment of the retracting chamber 14 is shown in FIGS. 1 and 2. Here the seal 18 has been removed (as compared to the embodiment described above with reference to FIG. 3-5) from the multipurpose element 12 and filters 23 have been added. By adding filters 23 in the multipurpose element 12, the fluid that fills the retracting chamber will be relatively clean well fluid. If the filters 23 are being clogged when filling the retracting chamber 14 with well fluid due to debris from the drilling, the filters 23 will more easily be unclogged when clean fluid is then pushed from the retracting chamber 14 and out into the well again forcing the clogging debris out the same way it entered, ensuring that the retracting chamber 14 is available for receiving the retracting drill bit 13.

By removing seal 18, this reduced the complexity in machining of parts and operation of the tool. A wiper 17 is still included to scrape away debris and ensuring minimum friction between the multipurpose element 12 and the rotating sleeve 2 as well as reducing the debris capable of entering the retracting chamber 14.

Other embodiment of the retraction chamber may be that the wiper and filter is removed to reduce the length of the multipurpose element 12 that will reduce complex machining of part as well as increasing the drill bit 13 extension reach. As previously mentioned, the multipurpose 12 element may take shape of a circular disk, splined disk or a disk with keys for transferring rotational forces that will further reduce complex machining of parts.

All the 4 benefits listed above are still present in all the alternative embodiments of the multipurpose element 12. However, if the multipurpose element 12 is in the shape of a circular disk without splines or the like, the advantage of transferring rotational forces will disappear, but all the other advantageous remain.

The drill bit 13 consists of a threaded section 24 and a fluted section 26. The drill bit may be a standard type drill bit, standard type mill bit or a customized hole making element. For all alternatives, the drill bit 13 is attached to the multipurpose element 12 by a threaded connection 24. A weakpoint 25 may be arranged where the diameter changes from the threaded section 24 to the fluted area 26 of the drill bit 13. If the drill bit 13 is stuck during drilling, the second hydraulic chamber 8 will normally create a sufficient force to pull the drill bit 13 apart leaving the fluted end 26 in the well and be able to recover the tool string without major recovery operation. The connection between the multipurpose element 12 and the drill bit 13 may be of other means than a single threaded connection, and the weak point may also be located in other positions than area specified in above example. Alternative method of connecting may be and are not limited by multi screw connections, groove connection etc.

Alternative weakpoint may be machined in stress concentrations in any location in the fluted part 26.

A second alternative if the drill bit 13 get stuck during drilling operation can be to unscrew the threaded connection 24 by rotating the rotating sleeve 2 in the counterclockwise direction. This will leave both the fluted section 26 and the threaded end 24 in the well and therefore a larger piece is left in hole. The threaded part sticking out of the hole will normally break off when the parts of the complete toolstring 22 are moved axially through the well.

Figure 6:
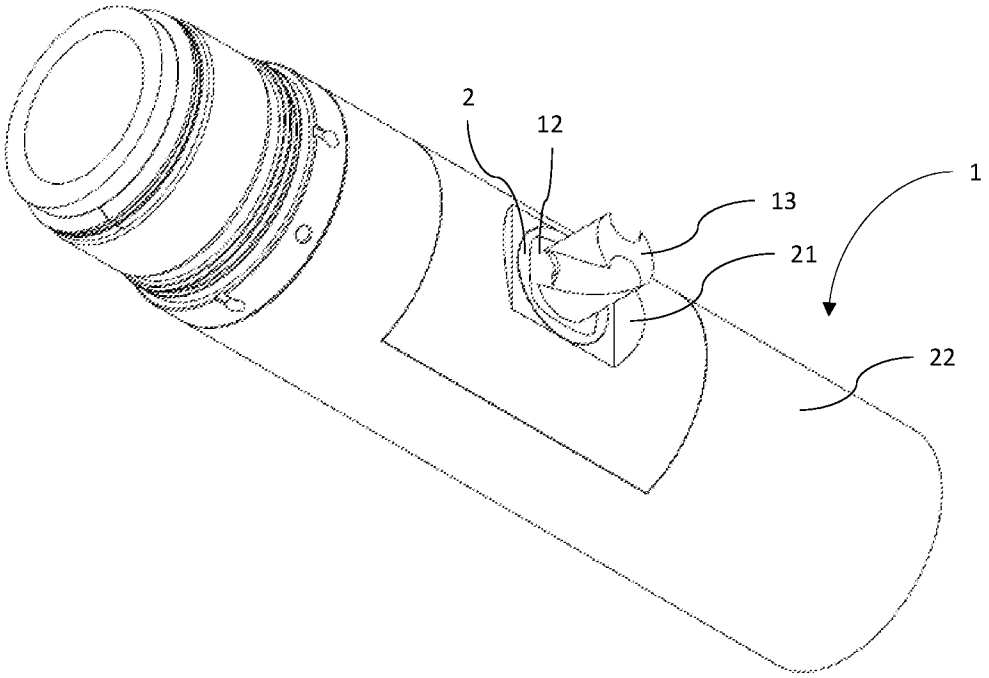
FIG. 6 shows a perspective view of a radial drill according to the invention with the drill bit in an extended position.
Figure 7:
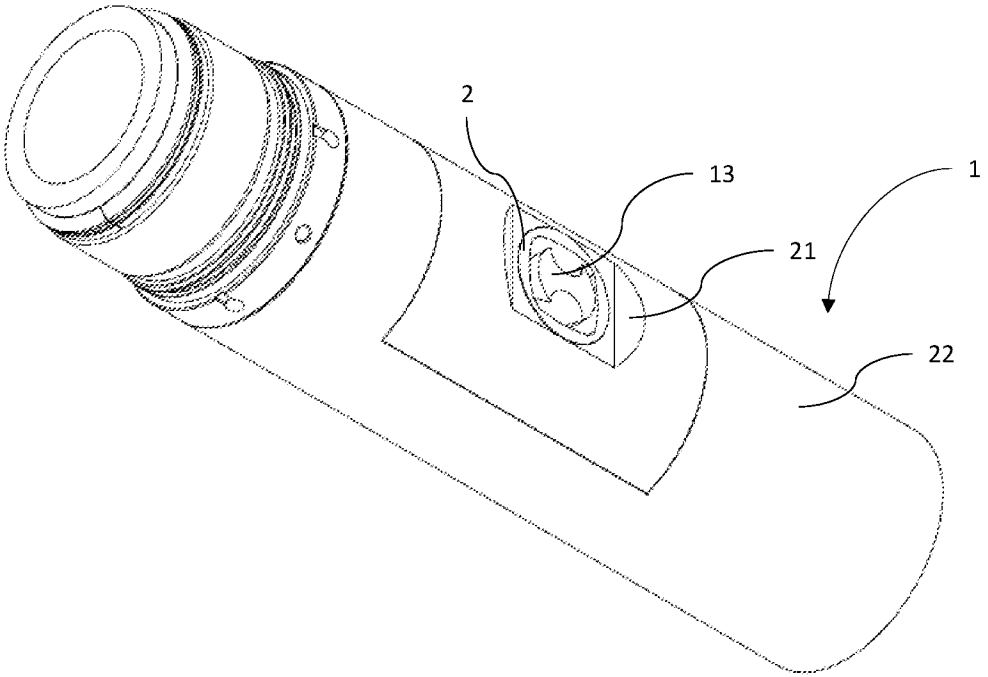
FIG. 7 shows a perspective view of a radial driller according to the invention with the drill bit in a retracted position.

FIGS. 6 and 7 shows a perspective view of the radial driller according to the invention with the drill bit in an extended and retracted position, respectively.

What is claimed is:

1. A radial driller for drilling a hole in a well tubular, the radial driller comprising:

a rotating sleeve that is rotated by means an axial drive organ via an angular gear, the rotating sleeve housing a partially closed cylinder, the cylinder housing a hydraulic piston;

a first hydraulic chamber situated below the hydraulic piston;

a second hydraulic chamber situated above the hydraulic piston, the hydraulic piston having a connecting rod arrangement extending above the piston and through an opening in a dividing wall dividing the cylinder from a multipurpose section; and a drill bit connected to the hydraulic piston via the connecting rod arrangement, wherein the radial driller further comprises a multipurpose element positioned directly below the drill bit, the multipurpose element defining a retracting chamber between the multipurpose element and the dividing wall, wherein the multipurpose element is arranged to provide a rotation transferring element that transfers rotation imparted from the surrounding rotating sleeve to the drill bit.

2. The radial driller of claim 1, wherein the multipurpose element is arranged in the multipurpose section and is connected via the connecting rod arrangement to the hydraulic piston.

3. The radial driller of claim 1, wherein the multipurpose element has (A) a polygon shape with 4 lobes, (B) 3 lobes, or (C) an oval shape with two lobes.

4. The radial driller of claim 1, wherein the multipurpose element is provided with a splined shape or a keyed shape that mates with a similar shape in the multipurpose section.

5. The radial driller of claim 1, wherein the hydraulic piston, the multipurpose element, and the connecting rod arrangement comprise suitable seals in a form of one or more of piston rings, o-ring seals, wiper elements, o-ring activated piston seals, or single element seals.

6. The radial driller of claim 1, wherein the hydraulic piston, the multipurpose element, and the connecting rod arrangement comprise:

suitable seals in a form of one or more of piston rings, o-ring seals, wiper seals, o-ring activated piston seals, or single element seals; and a filter organ.

7. The radial driller according to claim 1, wherein the retracting chamber has sufficient space into which the drill bit is configured to retract, wherein the retraction chamber is filled with clean oil during drill bit extension.

8. The radial driller according to claim 5, wherein the retracting chamber has sufficient space into which the drill bit is configured to retract, wherein the retraction chamber is filled with clean oil during drill bit extension.

9. The radial driller of claim 1, wherein the drill bit comprises a weakpoint.

* * * * *